US009693599B2

(12) United States Patent
Sanderson et al.

(10) Patent No.: US 9,693,599 B2
(45) Date of Patent: Jul. 4, 2017

(54) MOTORCYCLE BOOT

(71) Applicant: Fox Head, Inc., Irvine, CA (US)

(72) Inventors: Brian Sanderson, Hurricane, UT (US); Andre Hsi-an Lee, Irvine, CA (US); Jon Munns, Portland, OR (US); Robert Cropp, Pikesville, MD (US)

(73) Assignee: FOX HEAD, INC., Irvine, CA (US)

( * ) Notice: Subject to any disclaimer, the term of this patent is extended or adjusted under 35 U.S.C. 154(b) by 249 days.

(21) Appl. No.: 14/169,788

(22) Filed: Jan. 31, 2014

(65) Prior Publication Data

US 2014/0215856 A1 Aug. 7, 2014

Related U.S. Application Data

(60) Provisional application No. 61/760,073, filed on Feb. 2, 2013.

(51) Int. Cl.

| | |
|---|---|
| ***A43B 5/00*** | (2006.01) |
| ***A43B 5/14*** | (2006.01) |
| ***A43B 5/04*** | (2006.01) |
| ***A43B 13/41*** | (2006.01) |
| ***A43B 23/17*** | (2006.01) |
| ***A43B 23/22*** | (2006.01) |

(52) U.S. Cl.

CPC ..... *A43B 5/145* (2013.01); *A43B 5/0452* (2013.01); *A43B 13/41* (2013.01); *A43B 23/17* (2013.01); *A43B 23/22* (2013.01)

(58) Field of Classification Search

CPC ..... A43B 5/145; A43B 5/0452; A43B 13/10
USPC ..... 36/131, 118.2, 118.4, 118.8, 76 R, 75 R
See application file for complete search history.

(56) References Cited

U.S. PATENT DOCUMENTS 3,721,023 A * 3/1973 Kastinger ..... A43B 5/0452 36/118.2
4,062,133 A * 12/1977 McGee ..... A43B 3/02 36/131

(Continued)

OTHER PUBLICATIONS http://dirtrider.com/features/online-exclusives/141_1201_fox_instinct_boot_intro Denison, Chris. "Fox Instinct Boot Intro—Dirt Rider Magazine." Dirt Rider. Dirt Rider, Jan. 26, 2012. Web. Jan. 30, 2017.

(Continued)

*Primary Examiner* — Marie Bays
(74) *Attorney, Agent, or Firm* — Foley & Lardner, LLP

(57) ABSTRACT

Protective footwear, such as a motorcycle or motocross boot, can have a supple, leather boot feel. Disclosed footwear can have a hinged coupling between a foot-engagement structure and a lower-leg engagement structure to promote anatomically correct flexion in a wearer's ankle. The lower-leg engagement portion can define a ledge having a lowermost face configured to abut and matingly urge against an uppermost face of a ledge of the foot-engagement portion to limit an extent of pivoting of the hinged coupling. The hinged coupling, in some instances, can include a pair of opposed bushings, each defining an internal thread configured to matingly engage a corresponding outer thread on a stud. The stud can retain the lower-leg engagement portion and the foot-engagement portion in a pivotable relationship to each other. The opposed bushings can be keyed to matingly engage either a lateral portion of the foot-engagement portion or a medial portion of the foot-engagement portion.

18 Claims, 10 Drawing Sheets

(56) References Cited

U.S. PATENT DOCUMENTS 4,138,828 A * 2/1979 Kubelka ..... A43B 5/0423 36/118.7
4,334,368 A * 6/1982 Chalmers, II ..... A43B 5/0466 36/118.7
4,615,128 A * 10/1986 Borsoi ..... A43B 5/0454 36/118.7
5,033,210 A * 7/1991 Dodge ..... A43B 5/046 36/118.8
5,134,791 A * 8/1992 Gregory ..... A43B 1/0072 36/107
5,740,620 A * 4/1998 Giese ..... A43B 5/04 36/115
6,098,317 A * 8/2000 Lazzaroni ..... A43B 5/0411 36/101
6,226,898 B1 * 5/2001 Trimble ..... A43B 3/0047 36/10
6,327,796 B1 * 12/2001 Parisotto ..... A43B 5/0472 36/118.2
6,371,494 B1 * 4/2002 Bonaventure ..... A43B 5/0411 280/11.19
7,530,182 B2 5/2009 Munns
7,913,426 B2 * 3/2011 Valat ..... A43B 5/0405 36/102
8,307,572 B2 * 11/2012 Foxen ..... A43B 3/0047 36/109
2006/0168849 A1 * 8/2006 Valat ..... A43B 5/0405 36/131

OTHER PUBLICATIONS http://www.motorcycle-usa.com/2012/01/article/fox-racina-instinct-boot-review/ Waheed, Adam. "Fox Racing Instinct Boot Review." MotoUSA.com. MotoUSA.com, Jan. 31, 2012. Web. Jan. 30, 2017.

https://www.youtube.com/watch?v=1J6bXFoA_v8 Fox Racing. "Instinct Boot Launch Party." Online video clip. You Tube. You Tube, Feb. 7, 2012. Web. Jan. 30, 2017.

https://www.youtube.com/watch?v=R4P1afV5JG0 Curlys Motocross's Channel. "New Fox Instinct Boot Interview." Online video clip. You Tube. YouTube, Feb. 21, 2012. Web. Jan. 30, 2017.

https://www.youtube.com/watch?v=ZOlflkgg844 GrindTV. "Fox Instinct Boot Intro." TransWorld MOTOcross. Online video clip. You Tube. You Tube, Jan. 30, 2012. Web. Jan. 30, 2017.

* cited by examiner

MOTORCYCLE BOOT

RELATED APPLICATIONS

This application claims the benefit of and priority to U.S. Provisional Application Ser. No. 61/760,073, filed Feb. 2, 2013, the contents of which are hereby incorporated by reference as if recited in full herein for all purposes.

BACKGROUND

Millions of people around the world use motorcycles, and not just for utilitarian transportation purposes, but for recreational activities such as touring and vacationing, off-road exploration, and racing. Motorcycle racing is a multi-billion dollar industry just in North America. Amateur and professional racers compete in thousands of races every year all over Canada, Mexico, and the United States. For example, the American Motorcycle Association® (AMA) organizes racing competitions in six different categories: superbike, flat track, supermoto, motocross, supercross, and hillclimb. Motorcycle riding competitions also feature prominently in extreme sports competitions, such as the X Games® or the Dew Sports Action Tour™ competitions. Additionally, motorcycles and motocross have inspired or melded with other types of vehicles to create new forms of all-terrain vehicle (ATV) recreation, including quad racing, competitive snowmobile racing, and bicycle motocross (BMX).

Protective gear is a critical component for amateur and professional motorcycle enthusiasts, and manufacturers often tailor such equipment for specific uses. Off-road motorcycle riding and racing present unique challenges for protective riding gear. Not only must the equipment protect riders in the case of a fall, it must function in the face of unique hazards not seen in road riding or track racing. In all types of off-road motorcycle riding and racing, riders often face treacherous riding conditions while traveling over dirt, sand, mud, and snow. Off-road riders often must negotiate around trees and stumps, boulders, brush, and other terrain features.

Conventional, prior art riding boots have limited anatomical movement of a wearer's foot and lower leg, restricting the rider's agility and ability to maneuver the motorcycle. Conventional, prior art riding boots have also been constructed of hard plastic that provides little or no dampening of vibrations inherent in motorcycling. Conventional, prior art riding boots constructed of hard plastic have also been bulky, particularly near a wearer's fore foot, which is used to control a foot-operated rear brake lever (e.g., usually on the wearer's right side) or to control a foot-operated gear-shift lever (e.g., usually on the wearer's left side). Conventional prior art riding boots, with their stiffness and limited range of movement, tend to cause a wearer to fatigue more quickly.

Thus, there remains a need for motorcycle protective gear configured to accommodate natural anatomical movement of a rider's lower leg and foot. There also remains a need for motorcycle protective gear configured to provide sufficient tactile feedback to a wearer to permit the wearer to safely control the motorcycle. For example, there remains a need for motorcycle protective gear configured to adequately protect a wearer's foot and foreleg from debris, etc., while allowing a user to feel subtle changes in force applied to a foot-actuated lever, e.g., as the transmission shifts between or among gears. There also remains a need for motorcycle protective gear that reduces wearer fatigue.

SUMMARY

The innovations disclosed herein overcome many problems in the prior art and address the aforementioned as well as other needs. One aspect of the presently disclosed riding boot pertains to a limited-range, hinged coupling between a foot-engagement portion and a lower-leg-engagement portion of the boot. In some embodiments of disclosed boots, the foot-engagement portion defines a bearing surface configured to urge against a corresponding bearing surface defined by the lower-leg engagement portion when the foot-engagement portion is positioned in an extended, or nearly hyper-extended, position relative to the lower-leg engagement portion. However, as the bearing surfaces urge against each other, the foot-engagement portion of the boot is unable to extend further relative to the lower-leg engagement portion of the boot, preventing a wearer's ankle joint from hyper extending. Sometimes, the prevention of further extension of the foot-engagement portion relative to the lower-leg engagement portion is referred to as "lock-out" in the art. Some disclosed hinged couplings can permit anatomically correct flexure of a wearer's ankle within a predefined range of motion while simultaneously providing a relatively large degree of lateral stiffness.

Another aspect of the presently disclosed riding boot pertains to a threaded bushing configured, on one hand, to matingly engage with a pivotable member of the lower-leg engagement portion and, on the other hand, to threadably receive a threaded stud. In some instances, disclosed boots are configured to permit repetitive pivoting movement between the lower-leg engagement portion and the foot-engagement portion without loosening of a threaded engagement between the bushing and a corresponding threaded stud.

Yet another aspect of an innovative riding boot pertains to a polyurethane (PU) mid-sole construction. By using PU, or another suitable, resiliently compressible material to form a midsole, innovative riding boots provide enhanced flexibility, mobility and vibration dampening for a wearer's foot compared to conventional, prior art motocross boots.

These and other embodiments are described in more detail in the following detailed description and the figures. The foregoing is not intended to be an exhaustive list of embodiments and features of the innovative subject matter presently disclosed herein. Persons of ordinary skill in the relevant art are capable of appreciating other embodiments and features from the following detailed description in conjunction with the drawings.

The foregoing and other features and advantages will become more apparent from the following detailed description of disclosed embodiments, which proceeds with reference to the accompanying drawings.

BRIEF DESCRIPTION OF THE DRAWINGS

Unless specified otherwise, the accompanying drawings illustrate aspects of the innovative subject matter described herein.

DETAILED DESCRIPTION

Described herein are various principles relating to improved protective gear for motorcycling, such as riding boots, with motocross boots being but one specific example of disclosed protective gear. Although the various principles are described herein by way of reference to specific embodiments of motocross boots, this disclosure pertains to other types of protective gear. This disclosure references the accompanying drawings, which form a part hereof, wherein like numerals designate like parts throughout. The drawings illustrate specific embodiments, but other embodiments may be formed and structural and logical changes may be made without departing from the intended scope of this disclosure.

Overview

Figure 1:
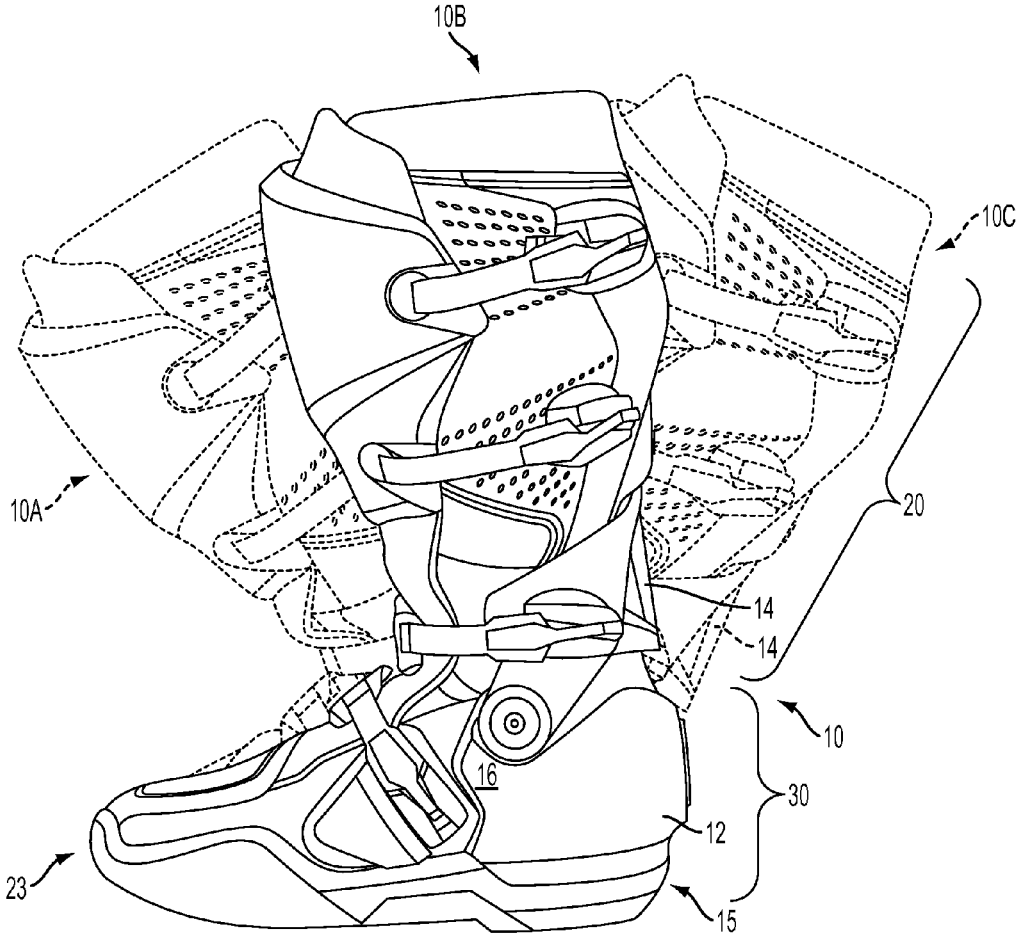
FIG. 1 shows a side elevation view of a riding boot of the type disclosed herein. The riding boot is shown in a fully flexed configuration, a fully extended configuration, and an intermediate, neutral configuration.

The motorcycle boot 10 shown in FIG. 1 provides substantially improved rider comfort compared to prior art boots. For example, the boot 10 is less restrictive of a wearer's movements, within anatomically acceptable ranges of motion, reducing rider fatigue and improving rider performance and safety a result. As described more fully below, the boot 10 includes a hinged coupling adjacent a wearer's ankle to permit the boot to flex within a limited range of motion, as a wearer's ankle does, while also including a "lock-out" or "stop" configured to prevent a wearer's ankle from over.

The motocross boot 10 shown in FIG. 1 has a sole unit 15 and an upper having a lower-leg engagement portion 20 and a foot-engagement portion 30. The foot-engagement portion 30 has a corresponding heel plate 12. The sole unit 15 may be disposed on: a front-rear axis running between the toe of the boot and the heel (which may be considered an X-axis); a top-bottom axis running between top of the boot that circles the calf of the wearer just below the knee and the bottom of the boot (which may be considered a Y-axis); and a medial-lateral axis running between the right side (inside, not shown in FIG. 1) and left side (outside, visible in FIG. 1) of the boot (which may be considered a Z-axis).

The sole unit 15 provides a platform for a wearer's foot and may be composed of any material providing suitable stiffness and protection, including plastics, rubbers (including cured or vulcanized rubbers), natural or synthetic compressed leather, or combinations thereof, including laminated sole units having layers of different materials, as will be described more fully below. Optionally, a metal plate (not shown) may be sandwiched within layers of the sole unit, a layer of compressible sponge or foam material (such as spongy ethyl vinyl acetate) can be added within the sole, and/or a metal toe plate may be mounted on the front toe area 23 of the sole 15. This toe plate offers additional protection and can facilitate shifting (or other foot-actuated controls) of the motorcycle while riding.

The upper 20, 30 extends upwardly from the sole unit 15, as shown in FIG. 1. It has an opening 31 for receiving a wearer's foot when the boot 10 is secured to a wearer's leg. The boot 10 typically is sized to receive the wearer's foot, ankle, and at least a portion of the wearer's lower leg. The upper 20, 30 includes a top edge portion that defines both an opening to receive a wearer's foot and lower leg and a transverse plane that is substantially perpendicular to the Z-axis of the boot 10. This transverse plane also is substantially parallel to the X-axis and Y-axis of the boot 10. When the boot is worn, this transverse plane intersects a portion of the wearer's lower leg through the tibia and fibula that is inferior to the knee joint and superior to the ankle. In particular embodiments, this transverse plane intersects the wearer's lower leg through the superior half of the tibia and fibula.

The upper 20, 30 may include several different components that serve functional or protective needs of a wearer, as described more fully in U.S. Pat. No. 7,530,182, which is incorporated herein by reference, for all purposes. Any suitable material that provides the minimum physical characteristics may be used to construct each part of the upper; the following descriptions of suitable materials are presented for exemplary purposes only and should not be interpreted as providing an exhaustive range of suitable materials. Combinations of these materials may be used in constructing various parts of the motorcycle boot as well.

An impact shield functions as a protective layer or shield that reduces the risk of a wearer suffering injury if he is struck by a flying object, collides with another rider, accidentally falls of a motorcycle, or suffers some other trauma to the legs. The impact shield need not cover or surround the entire upper, or even a major portion of the upper, and while the impact shield forms the outer layer of the upper in many embodiments, the shield alternatively may form a different layer of the upper. Suitable materials for constructing the impact shield include: hard yet flexible thermoplastics, rubbers, elastomers, and other polymers such as PE (polyethylene), HDPE (high density polyethylene), high impact polypropylene, TPU (thermoplastic urethane), Ortholite™ Rubthane™, and different nylon formulations; metals or alloys, such as aluminum, stainless steel, steel, and tungsten; or woven fabrics (including blended fabrics), laminates, or composites, such as Kevlar®, ballistic nylon, carbon fiber, and fiberglass. In selected embodiments, a dual-density or dual-durometer shield is constructed from at least two different materials having different densities or hardness ratings. For example, the shin guard portion of the shield (covering the shin of the wearer) may be made from a harder, denser material like TPU while portions intended for control or manipulation of the motorcycle may be made from a softer, less dense material like Rubthane.

An attachment system secures the footwear to the wearer's foot and at least a portion of the wearer's lower leg above the ankle. Suitable materials for constructing the buckles and anchors of the attachment system include: rigid thermoplastics, such as PVC (polyvinyl chloride) or PS (polystyrene), nylons, or TPU; and metals or alloys, such as aluminum, steel, tungsten, or nickel. Straps of the attachment system may be constructed from thermoplastics such as PE (polyethylene), HDPE (high density polyethylene), LDPE (low density polyethylene), or high impact polypropylene; and woven fabrics (including blended fabrics) or flexible laminates and composites, such as cotton, rayon, nylon, spandex, Kevlar®, polyester, or rayon.

Design indicia can be intended to provide an aesthetic look to the finished product, create a brand for the product, and/or identify the source of the product in the minds of consumers. Suitable materials for such indicia include: rigid thermoplastics, such as PVC (polyvinyl chloride), PS (polystyrene), fine mold TPU (thermoplastic urethane), and metals or alloys, such as aluminum, steel, tungsten, or nickel. In selected embodiments, the indicia are partially or completely chrome plated.

A toe/instep control area provides a moderate to high friction surface in the front area of the boot to facilitate operation and control of the motorcycle (or other motor vehicle), and the toe/instep control area may be softer than the underlying base material. Suitable materials for manufacturing the toe/instep control area include: elastomers, rubbers, and thermoplastics such as LDPE (low density polyethylene), neoprene, polychloroprene latexes, chlorosulfonated polyethylene synthetic rubber, ethylene octene copolymers, and EPDM (Ethylene Propylene Diene Monomer).

Mixtures of the materials mentioned herein also may be used including (but not limited to) fiberglass reinforced nylons or carbon fiber and Kevlar® blends. Any of these materials may be altered, coated, or otherwise treated with an additive, such as a pigment or coloring agent; emulsifiers; reinforcing agents; antimicrobial agents; flame retardants; or thermal insulators. Additionally, the shape or surface of any boot component may be altered for aesthetic or functional purposes, including (but not limited to) molding, shaping, texturing, scoring, painting, printing, stamping, pressing, and embroidering.

The gaps or open areas of the boot upper not covered by the impact shield typically are not as prone to environmental injury (from flying objects, obstructions, contact with the motorcycle, and the like) while a wearer is riding a motorcycle. Leaving these areas of the boot upper open—rather than being covered by additional portions of the impact shield—facilitates flexion of the foot during riding and reduces excess weight of the boot. Foot and leg movement may be an important part of controlling motorcycle operation, so this balance between providing hard, but less flexible, protective surfaces and flexible, but less protective, areas that facilitate foot movement may be an important consideration in designing any protective motocross boot. Additionally, excess weight of any protective gear, including motocross boots, may adversely affect a wearer's performance during use, particularly during strenuous competitive or recreational activities such as motocross racing or off-road motorcycle riding. Accordingly, in view of the forgoing, person skilled in the art may vary areas of coverage to meet particular design considerations.

The foot/leg encasement typically forms the innermost layer of the upper that encloses the wearer's foot and leg. It may include cushioning to provide a softer, more comfortable, adjustable fit. The encasement may be made from natural or synthetic fabrics or technical textiles (including blends and treated or coated fabrics and materials), such as natural or synthetic leather, polyethylene coated leather, cotton, polyester, nylon, rayon, spandex and other polyurethane-based elastane textiles, flexible polyurethane foams, cotton batting, latex foam, Biofoam™, and impact-reducing gels. In selected embodiments, the encasement includes air pockets or chambers to further reduce shocks and impacts.

A thermal laminate is a protective layer and thermal insulator intended to protect the boot and the wearer from heat-related damage or injury. Suitable materials for the thermal laminate include: natural or synthetic leathers, such as suede leather; woven natural or synthetic fabrics (including blended, coated, or treated fabrics) including ceramic textiles and textiles containing carbon fiber or aramid (aromatic polyamide), meta-aramid, or para-aramid fibers, such as Nomex® or Kevlar®; natural and synthetic rubbers and elastomers such as: polychloroprene, chlorosulfonated polyethylene, perfluoroelastomers, ethylene octene copolymers, EPDM, polychloroprene latexes, and other polyolefins; or plastics and other polymers, such as mylar, PU, and LDPE.

As shown in FIG. 1, a heel plate 12 is fixedly attached to upper 20, 30 in a region adjacent the sole unit 15. The heel plate is intended to provide an additional layer of protection (in addition to the impact shield) over the heel area, such as over the Achilles tendon. Suitable materials for the heel plate include: rigid thermoplastics, such as PVC (polyvinyl chloride), PS (polystyrene), TPU (thermoplastic urethane); and metals or alloys, such as aluminum, stainless steel, tungsten, and nickel.

As also shown in FIG. 1, a lower-leg plate 14 is pivotably coupled to the heel plate 12 in a region 16 generally outward, and aligned with an axis-of-rotation, of a wearer's ankle. Such a configuration permits the lower-leg engagement portion 20 to pivot relative to the foot engagement portion 30 in an anatomically correct motion within a plane defined by X-Y coordinate axes described above (e.g., permits rotation about an axis substantially parallel to the Z coordinate axis described above), while providing substantial torsional rigidity to inhibit rotation about axes substantially parallel to the X coordinate axis and the Y coordinate axis described above.

FIG. 1 depicts the boot 10 in three configurations. In position 10A, the lower-leg engagement portion 20 is pivoted forward to a maximum extent. That is, in the left boot 10 shown in FIG. 1, the wearer's foot is flexed such that the foot-engagement portion 30 is rotated clockwise (when viewed from a lateral position as in FIG. 1) relative to the lower-leg engagement portion 30, bringing the toe region 23 of the boot 10 into a proximal position relatively close to the anterior region of the lower-leg engagement portion.

In position 10C, the lower-leg engagement portion 20 is pivoted rearward to a maximum extend. That is, in the left boot 10 shown in FIG. 1, the wearer's foot is extended such that the foot-engagement portion 30 is rotated counter-clockwise (when viewed from a lateral position as in FIG. 1) relative to the lower-leg engagement portion 30, distally extending the toe region 23 to a position relatively far from the anterior region of the lower-leg engagement portion.

In the extended position 10C, a ledge defining a lowermost face 15 of the lower-leg plate 14 matingly abuts and urges against a correspondingly configured ledge defining an uppermost face 13 of the heel plate 12. Such a mating abutment between the ledges can inhibit over extension (or hyperextension) of the wearer's foot (e.g., inhibits further counter-clockwise rotation of the foot engagement portion 30 depicted in FIG. 1), which can limit the degree of flexion in the wearer's ankle to within an anatomically acceptable range of motion, decreasing a likelihood of a wearer suffering an injury to the ankle from moderate impacts that tend to extend the wearer's foot.

The hinged coupling between the lower-leg engagement portion 20 and the foot engagement portion 30 promotes flexion of the wearer's ankle joint in an anatomically correct form, within a selected, predetermined range of motion (e.g., between positions 10A and 10C shown in FIG. 1). Inhibiting over rotation of a wearer's foot relative to the lower leg can reduce a risk of, for example, hyperextending the wearer's ankle. The position 10C shown in FIG. 1 is sometimes referred to as a "lock-out position" in the art. The correspondingly configured lowermost face 15 and uppermost face 13 are sometimes referred to together in the art as a "stop".

Hinge

Figure 2:
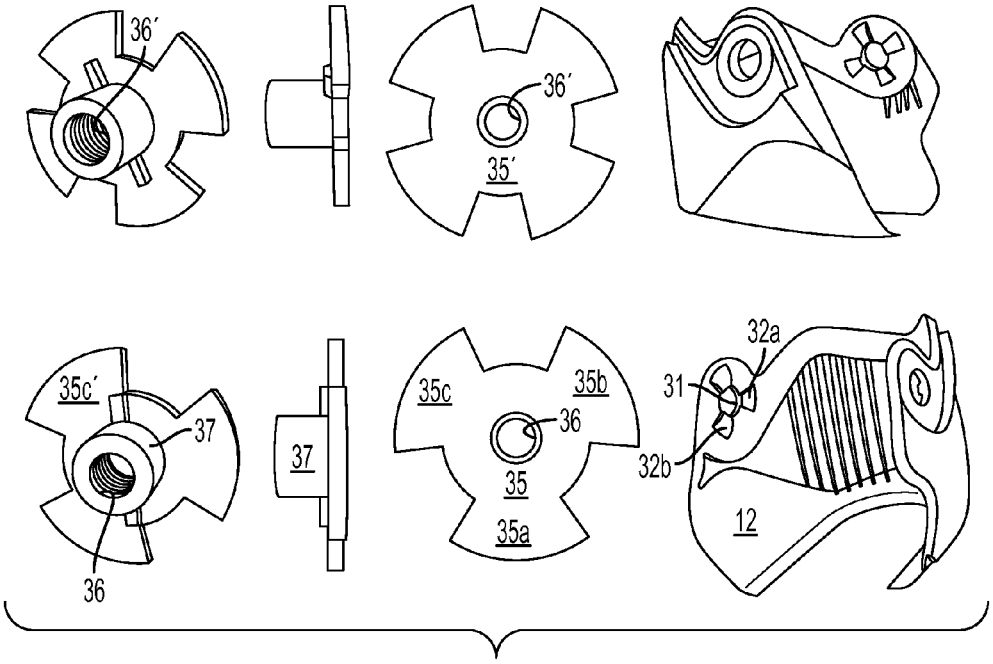
FIG. 2 shows (A) alternative embodiments of threaded bushings configured to matingly engage a heel plate of a riding boot of the type shown in FIG. 1; and (B) alternate perspective views of such a heel plate.

FIGS. 2 through 6 illustrate aspects of the hinged coupling between the lower-leg engagement portion 20 and the foot engagement portion 30 of the boot 10. FIG. 2 illustrates, clockwise from the upper left, (A) a perspective view of a first threaded bushing 35'; (B) a side-elevation view of the first threaded bushing; (C) a medial plan view of the first threaded bushing; (D) a perspective view of a heel plate 12; (E) a second perspective view of the heel plate; (F) a medial plan view of a second threaded bushing 35; (G) a side-elevation view of the second threaded bushing; and (H) a perspective view of the second threaded bushing.

Figure 7:
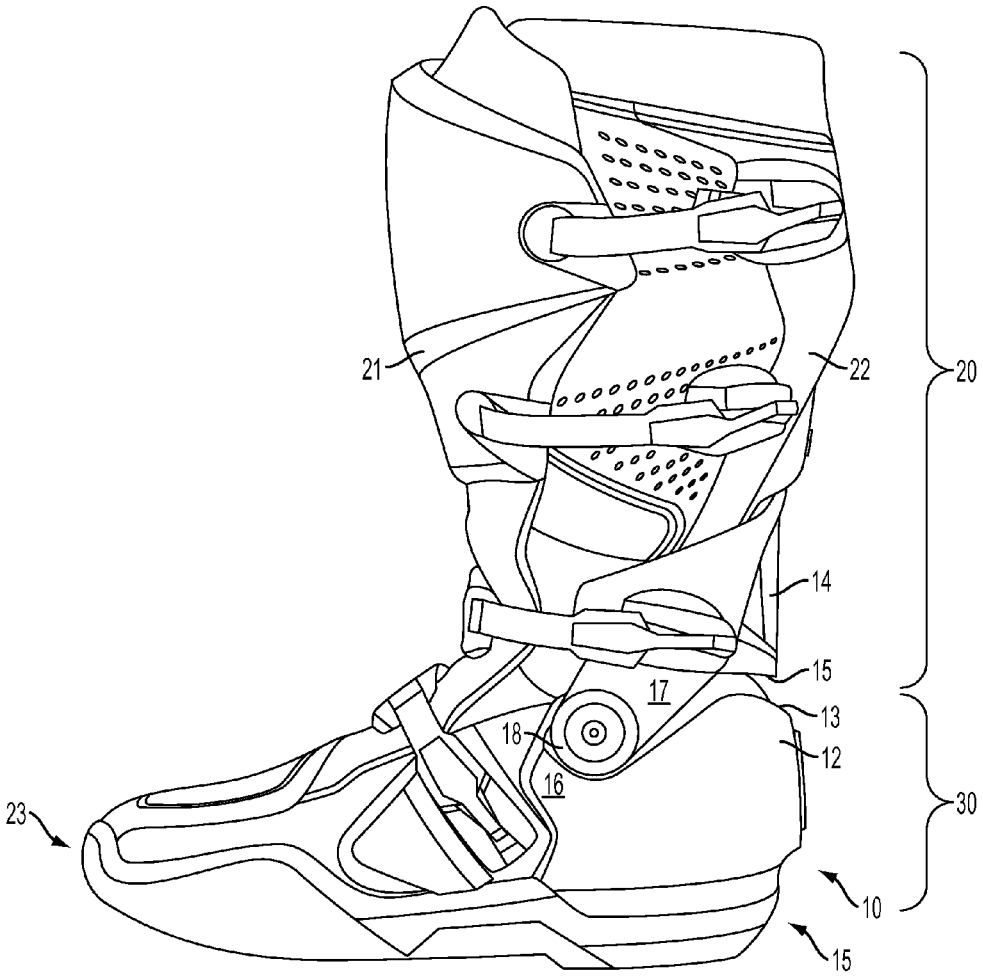
FIG. 7 shows side elevation view of a working embodiment of riding boot as shown in FIG. 1.
Figure 8:
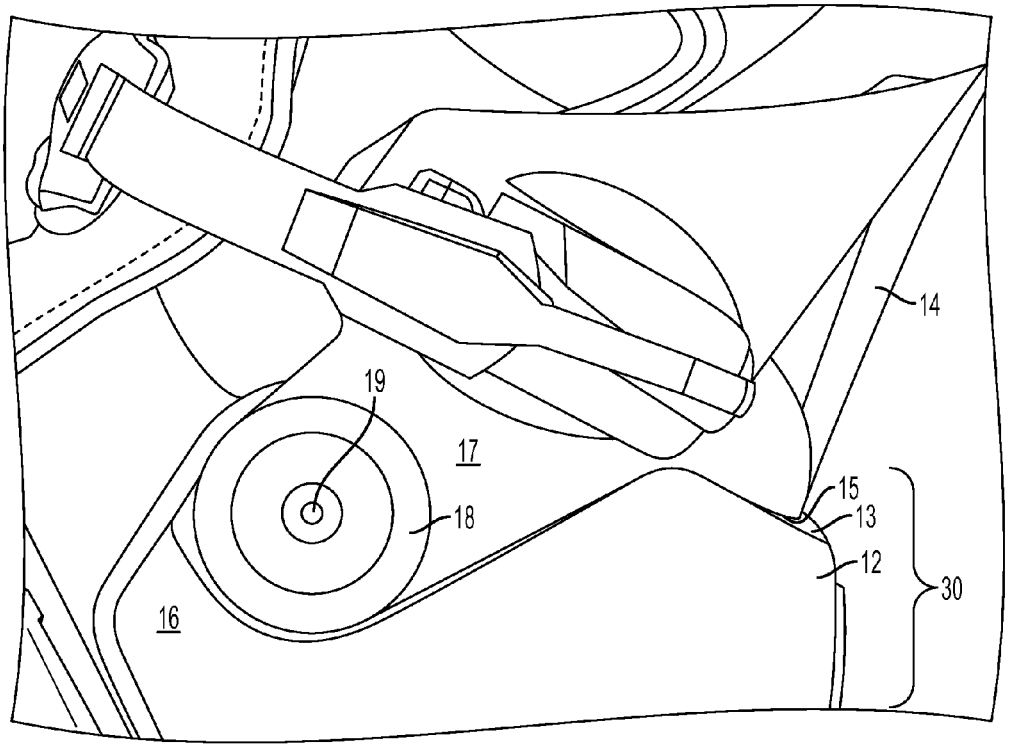
FIG. 8 shows an enlarged portion of the boot shown in FIG. 7 in a lock-out configuration (e.g., configured with the lower-leg engagement portion a position of maximum extension relative to the foot-engagement portion).

FIGS. 7 and 8 illustrate additional aspects of the hinged coupling between the lower-leg engagement portion 20 and the foot engagement portion 30 of the boot 10. FIG. 7 shows a portion 17 of the lower-leg plate 14 extending downward and forward of the rear portion of the lower leg to overlie a portion of the boot 10 positioned outward of a wearer's ankle, as well as a portion 16 of the heel plate 12 extending forward and upward to overlie the wearer's ankle. A stud 19 extends inwardly through the portion 17 of the lower-leg plate 14 and through the portion 16 of the heel plate 12, pivotably coupling the lower-leg plate 14 and the heel plate 12 to each other. In the example shown in FIG. 8, a washer 18 is positioned between a head of the stud 19 and the lower-leg plate 14 to distribute a compressive load applied to the heel plate by the head of the stud.

In some instances, as with the working embodiment depicted in FIGS. 7 and 8, the stud 19 can define a shaft (not shown) having an outer thread configured to removably engage a correspondingly configured inner thread within a recess defined by a bushing 35, 35' (FIGS. 2 through 6). When assembled, the lower-leg plate 14 overlies a portion 16 of the heel plate 12. Each of the lower-leg plate 14 and the heel plate 12 defines a respective aperture (e.g., aperture 31, 31' defined by heel plate 12). When assembled, the respective apertures are in substantial alignment so as to define a common axis extending therethrough.

Figure 4:
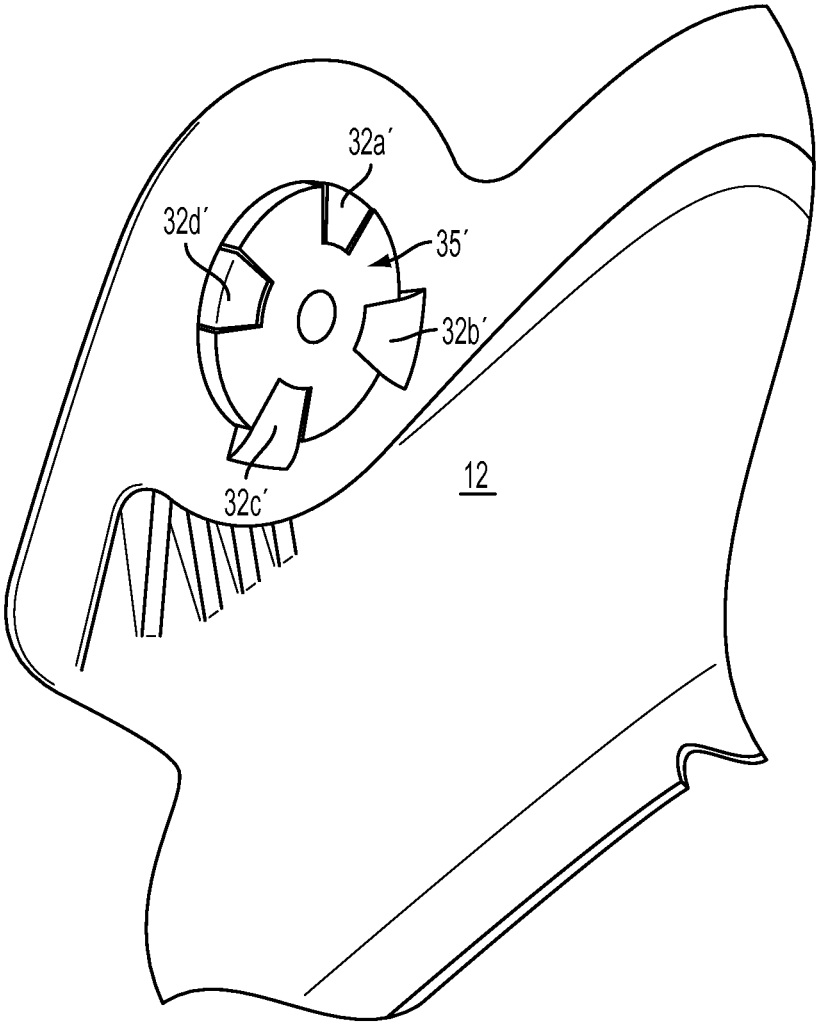
FIG. 4 shows a photograph of one of the threaded bushings shown in FIG. 3 in a mating engagement with a portion of the heel plate shown in FIG. 3.
Figure 5:
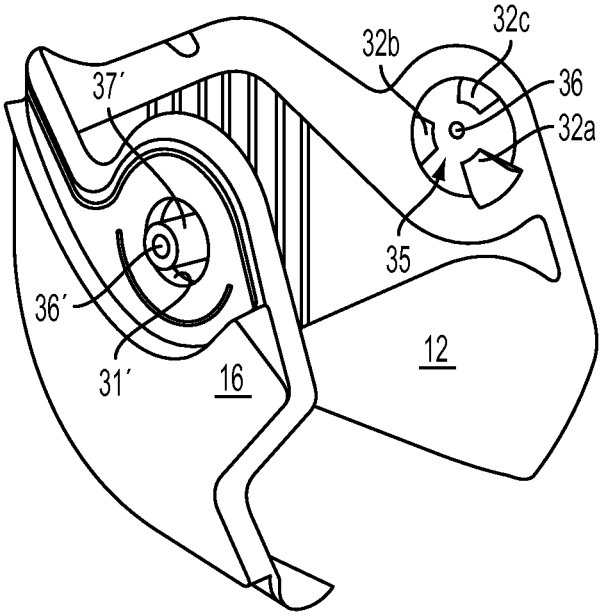
FIG. 5 shows a photograph of both of the threaded bushings shown in FIG. 3 in mating engagement with the heel plate shown in FIG. 3.
Figure 6:
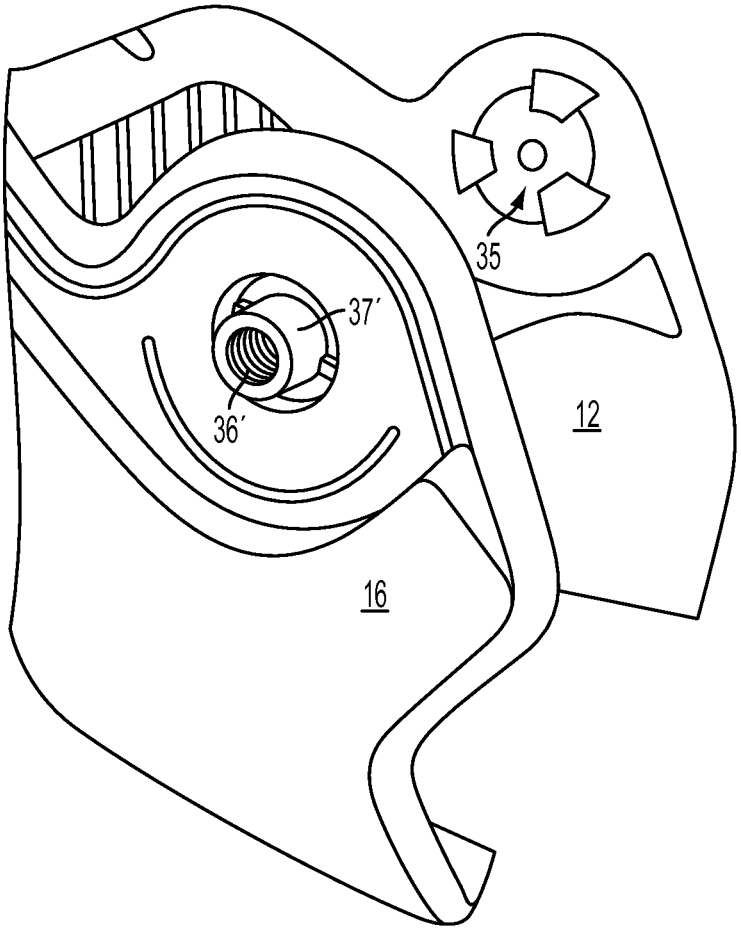
FIG. 6 shows another photograph of both of the threaded bushings shown in FIG. 3 in mating engagement with the heel plate shown in FIG. 3.

A bushing 35, 35' (sometimes referred to as a "hinge bushing" in the art) can be positioned within the aperture 31, 31' of the heel plate 12 such that a shank 37, 37' extends outwardly through the aperture 31, 31', as shown in each of FIGS. 4, 5 and 6. The shank 37, 37' defines a recess 36, 36' having an internal thread configured to matingly engage with an outer thread defined by the shaft (not shown) of the stud 19. The aperture defined by the portion 17 of the lower-leg plate 14 can be positioned in alignment with the aperture 31, 31', and a threaded stud 19 can be removably engaged with the threaded recess of the bushing, retaining the lower-leg plate 14 in pivotable relation to the heel plate 12.

Figure 3:
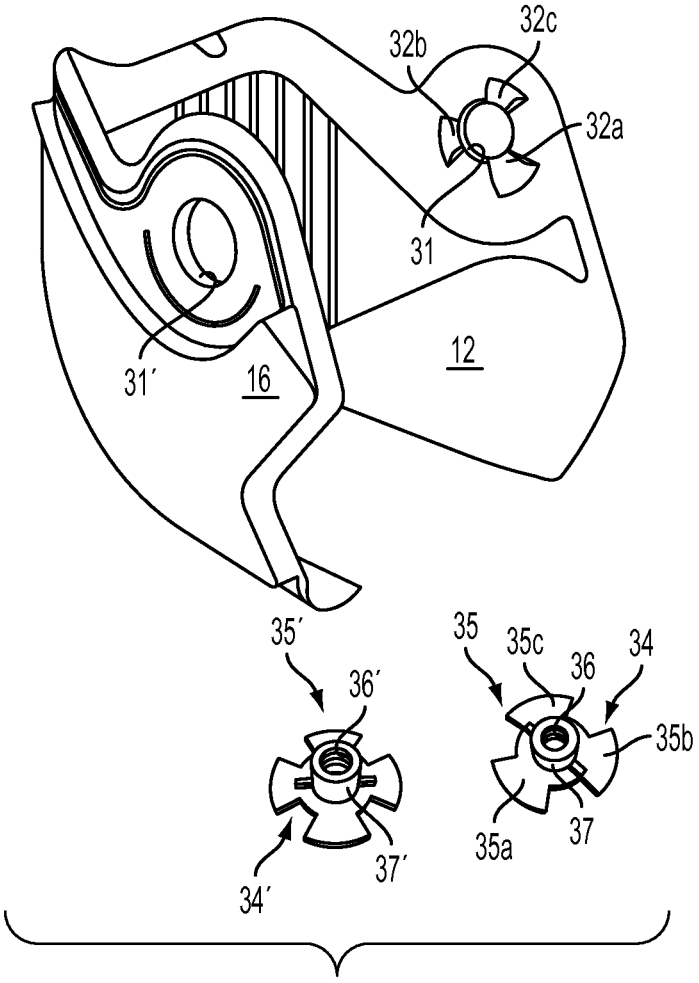
FIG. 3 shows a photograph of a working embodiment of a heel plate of the type shown in FIG. 2, together with two working embodiments of threaded bushings of the type shown in FIG. 2.

As shown in FIGS. 2, 3 and 4, each of the first and the second threaded bushings 35, 35' can define plural features configured to matingly engage with correspondingly configured features defined by the heel plate 12. A mating (or "keyed") engagement between a threaded bushing 35, 35' and the heel plate 12 can prevent the bushing from rotating relative to the heel plate 12 when the lower-leg plate 14 of the lower-leg engagement portion 20 pivots relative to the heel plate 12. Preventing rotation of the threaded bushing provides at least two advantages. First, the bushing 35, 35' is prevented from rotating when the threaded stud 19 is threaded into the recess 36, 36', allowing a suitable torque to be applied to the stud 19 to retain the stud within the bushing. (In contrast, a bushing with a round or other configuration permitting rotation of the bushing typically needs to be retained using a tool during assembly, slowing manufacturing and increasing overall costs, and making subsequent removal of the threaded stud difficult.) Second, fixedly retaining the bushing 35, 35' relative to the heel plate 12 prevents or at least inhibits unintentional disengagement of the stud 19 from the bushing 35, 35' that otherwise might occur from a pivoting motion of the lower-leg plate 14 relative to the heel plate 12.

The bushings 35, 35' can have a segmented outer periphery defining a plurality of recessed regions 34, 34' (FIG. 3) juxtaposed with a plurality of flutes 35*a, b, c* (FIG. 2). Such a bushing configuration can allow the bushing to matingly engage with the heel plate 12 as just described. The bushings 35, 35' shown in FIG. 3 are configured differently from each other to provide a "keying" feature. That is, to permit one bushing 35 to matingly engage only a medial (or only a lateral) side of the heel plate 12 and to permit the other bushing to matingly engage only the other (medial or lateral) side of the heel plate.

In some embodiments, the threads within each recess 36, 36' of the respective bushings 35, 35' can be in different directions to inhibit or prevent the bushings 35, 35' from disengaging from the stud 19 as a result of the many pivoting cycles expected of the boot 10 during use. For example, a left-handed thread can be defined within one bushing and a right-handed thread can be defined in the other bushing. Keying the bushing having a left-handed thread in a different manner than the keying of the bushing with the right-handed thread can facilitate manufacturing processes. For example, a bushing having a left-handed thread and being keyed different than a bushing having a right-handed thread can decrease a likelihood of the bushing with the left-handed thread inadvertently being positioned in an aperture 31, 31' intended to receive a bushing with a right-handed thread. Other keying features than those depicted in the drawings and described above are possible.

With such a configuration of the lower-leg plate (sometimes referred to as a "cuff" in the art), the cuff can rotate around the bushing shank 37 (FIG. 3), rather than cause the bushing to rotate within the assembly due to friction between the bushing and the cuff. Such a configuration allows the threaded stud 19 to remain tightly engaged within the threaded recess 36.

Midsole

Figure 9:
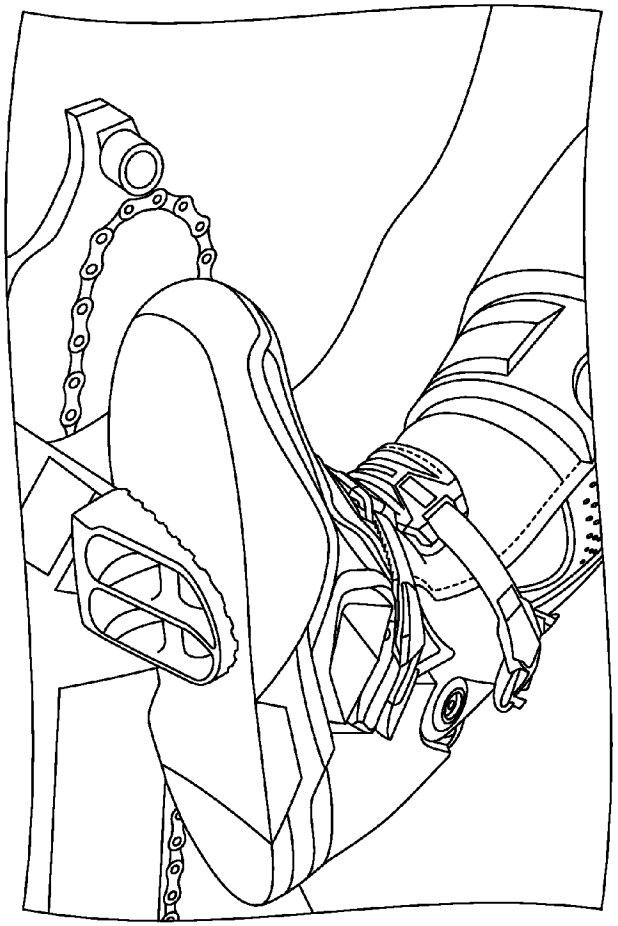
FIG. 9 shows a working embodiment of a boot of the type shown in FIGS. 1 and 7 in use.

As shown in FIG. 9, a motorcycle rider's foot can be supported on a foot peg extending outwardly of the motorcycle. In some instances, as shown in FIG. 9, a rider's foot can be positioned above the foot peg such that the foot peg is positioned below, and slightly in front of, the arch of the rider's foot. However, to shift gears of a typical motorcycle transmission, the rider's left foot is usually slid forward on the peg so the rider's toe can urge the shift lever up or down in correspondence with the desired gear change. When the rider's left foot is slid forward to operate the shift lever, the foot peg is positioned generally below the rider's arch. Similarly, the rider's right foot can be slid forward to urge a lever for actuating a rear wheel brake.

Figure 11:
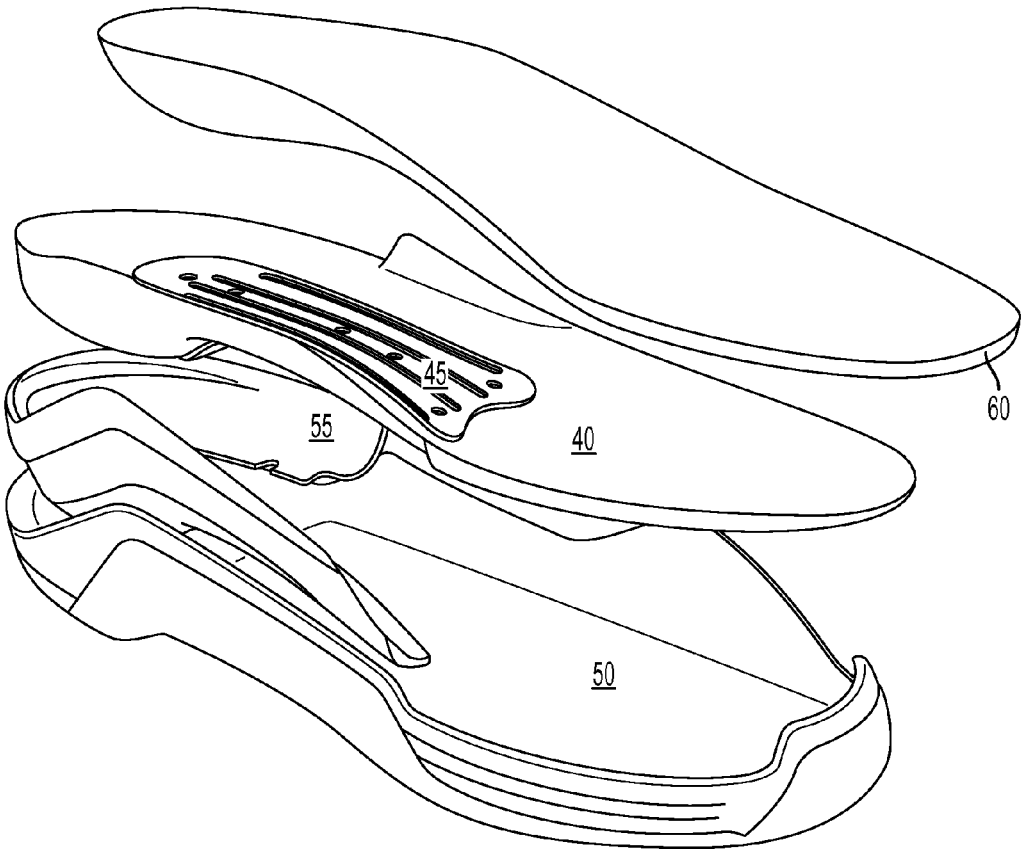
FIG. 11 shows an exploded, perspective view of a portion of a sole unit for a riding boot of the type disclosed herein.

As shown in FIG. 11, disclosed boots can have an insole 60, a midsole 40 with a shank 45, heel stabilizer 55 and an outsole 50. The insole can be formed from a dual density EVA material. A soft, pliant EVA provides a wearer with comfort when the boot is donned, and the relatively stiffer EVA provides support to the wearer's foot.

Figure 10:
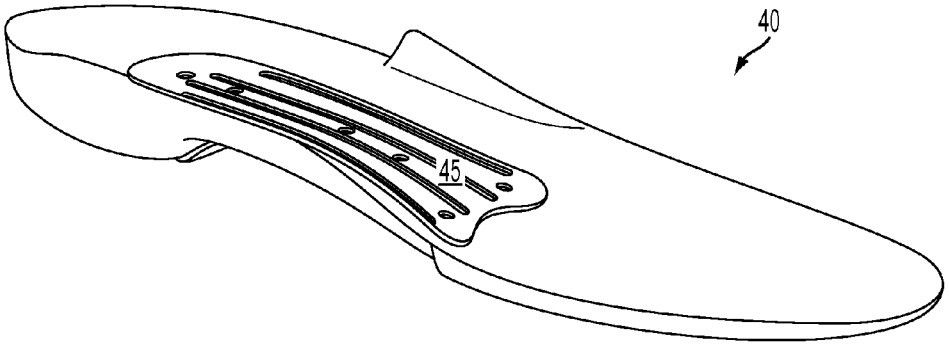
FIG. 10 shows a mid-sole of the type disclosed herein.

Some embodiments of innovative boots described herein comprise a midsole formed, in part, of a polyurethane material. In contrast to conventional motocross and other motorcycle riding boots, disclosed midsoles 40 can be formed of a relatively pliant polyurethane material, instead of the hard and stiff lasting board found in conventional motorcycle riding boots. The polyurethane gives the boot an enhanced flex, mobility and vibration dampening compared to conventional motocross boot construction. The polyurethane midsole 40 (FIGS. 10 and 11) allows a rider's foot to rest above a soft midsole providing improved step in comfort, excellent tactile feedback from the motorcycle, and substantial vibration dampening to reduce or eliminate rider fatigue.

As FIG. 11 shows, a tempered steel shank can be encapsulated in the polyurethane mid-sole giving the boot needed support above the foot peg while still giving the rider substantial comfort to flex and extend the foot when activating a brake or gear-shift lever, reducing rider fatigue.

A substantially rigid heel stabilizer 55 can be formed of TPU and bonded directly to the polyurethane mid sole 40, 45, giving the boot 10 additional support in the heel. The outsole 50 can be formed of a rubber material having material properties suitable to provide improved durability and tactile feedback to a wearer.

Explanation of Terms

The following explanations of terms are intended to supplement, but not contradict or contravene, their ordinary dictionary definitions. While some terms are described relative to a human or animal body, the same descriptive terms can be adapted for use with inanimate objects, such as the protective footwear described herein. For example, the medial side of a motocross boot is the side closest to the midline of a wearer's body when the boot is worn.

Anterior. When referring to the human body, "anterior" structures or objects are near the front of the body. For example, the nose is located on the anterior side of the head. "Anterior" also corresponds to the term "ventral" used in general vertebrate biology.

Coronal plane. When referring to vertebrate anatomy, the coronal plane divides the body into dorsal and ventral portions (or, when referring to human anatomy specifically, the coronal plane divides the body into anterior and posterior portions).

Deep. When referring to human or animal anatomy, the term "deep" (also equivalent to "profound" or "internal") refers to structures that are inside the human body away from the body surface. For example, the hypothalamus is a deep gland within the human head.

Distal. When referring to a human or animal body, "distal" refers to a point that is further away from the main body (as opposed to "proximal"). For example, after a fly fisherman has made a cast, he has cast the distal end of the fishing line away from him.

Inferior. When referring to human anatomy, parts of the body that are "inferior" are farther away from the head. For example, the ankle is inferior to the knee.

Lateral. Those structures near the sides of a human or other animal, and further away from the body's midline, are described as being "lateral" (as opposed to "medial"). For example, the human ears are positioned lateral relative to the human eyes, and the "pinky toe" of the foot is the most lateral toe.

Medial. Those structures near or closest to the midline of a human or other animal, and further away from the body's outsides, are described as being "medial" (as opposed to "lateral"). For example, the human breast bone is medial to either shoulder blade, and the "big toe" of the foot is the most lateral toe.

Median plane. In vertebrate anatomy, the median plane passes between the top and the bottom of the body and separates the left and the right sides of the body in equal halves.

Posterior. When referring to the human body, "posterior" structures or objects are near the back of the body. For example, the spine runs through the posterior portion of the torso. "Posterior" also corresponds to the term "dorsal" used in general vertebrate biology.

Proximal. When referring to a human or animal body, "proximal" refers to a point that is closer to the main body (as opposed to "distal"). For example, a person holding the very end of a rope holds the proximal end of that rope.

Sagittal plane. In vertebrate anatomy, a sagittal plane divides the body into left and right portions. The midsagittal plane falls within the midline of the body and passes through midline structures such as the human navel or spine. All sagittal planes are considered parallel to the midsagitall plane.

Superficial. When referring to human or animal anatomy, the term "superficial" (or "external") refers to structures that are on or close to the body surface. For example, sweat glands occupy a superficial position on the human body within the skin.

Superior. When referring to human anatomy, parts of the body that are "superior" are closer to the head. For example, the collar bone is superior to the pelvis.

Transverse plane. Regarding vertebrate biology, the transverse plane divides the body into cranial and caudal portions (or, when referring to human anatomy specifically, the transverse plane divides the body into superior and inferior portions). When referring to inanimate objects, a transverse plane runs perpendicular (or substantially perpendicular) to a longitudinal axis of the object.

Unitary piece. A "unitary piece," "unitary part," or "unitary construction" are used interchangeable to mean a single-unit construction made from one material or a mixture of materials fused or meshed together (such as an alloy, a blended plastic, or a fabric woven from a plurality of threads or yarns). An injection molded part (including a single piece made by a co-molding process) is considered a "unitary piece." A part constructed by joining two manufactured pieces together—such as by gluing or adhesively bonding, stapling, stitching, riveting, welding, or the like—is not considered a "unitary piece."

Directions and references (e.g., up, down, top, bottom, left, right, rearward, forward, etc.) may be used to facilitate discussion of the drawings but are not intended to be limiting. For example, certain terms may be used such as "up," "down,", "upper," "lower," "horizontal," "vertical," "left," "right," and the like. Such terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" surface can become a "lower" surface simply by turning the object over. Nevertheless, it is still the same surface and the object remains the same. As used herein, "and/or" means "and" or "or", as well as "and" and "or."

All references, including any prior art references, referred to herein are hereby incorporated by reference for all purposes.

One or more principles relating to any example described herein can be combined with one or more other of the principles described in relation to any of the examples described herein. Accordingly, this detailed description shall not be construed in a limiting sense, and following a review of this disclosure, those of ordinary skill in the art will appreciate the wide variety of headwear that can be devised using the various concepts described herein. Moreover, those of ordinary skill in the art will appreciate that the exemplary embodiments disclosed herein can be adapted to various configurations without departing from the disclosed principles. Thus, in view of the many possible embodiments to which the disclosed principles can be applied, it should be recognized that the above-described embodiments are only examples and should not be taken as limiting in scope. We therefore reserve all rights to the subject matter disclosed herein, including the right to claim all that comes within the scope and spirit of the following claims, as well as all aspects of any innovation shown or described herein.

The invention claimed is:

1. A motorcycle riding boot comprising:

a sole unit; and an upper including:

a lower-leg engagement portion having a first ledge defining a lowermost face;

a foot engagement portion having a second ledge defining an uppermost face; and a pivotal coupler positioned to pivotally couple the lower-leg engagement portion to the foot engagement portion, the pivotal coupler including a bushing that is rotationally fixed to the foot engagement portion such that the lower-leg engagement portion pivots relative to the bushing and the foot engagement portion;

wherein the first ledge is positioned to engage the second ledge at a target degree of extension of the foot engagement portion relative to the lower-leg engagement portion such that the lowermost face and the uppermost face urge together in a mating abutment to limit a range of motion of the lower-leg engagement portion relative to the foot engagement portion to within an anatomically acceptable range of motion.

2. A motorcycle riding boot according to claim 1, further comprising:

a lower-leg plate that defines the first ledge; and a heel plate that defines the second ledge.

3. A motorcycle riding boot according to claim 2, wherein the lower-leg plate is coupled to the lower-leg engagement portion such that the first ledge extends around a rear of the lower-leg engagement portion, and wherein the heel plate is coupled to the foot engagement portion such that the second ledge extends around a rear of the foot engagement portion.

4. A motorcycle riding boot comprising:

a sole unit;

an upper including:

a lower-leg engagement portion; and a foot engagement portion; and a pivotable coupler configured to pivotably couple the lower-leg engagement portion to the foot engagement portion such that the lower-leg engagement portion pivots relative to the pivotable coupler and the foot engagement portion, wherein the pivotable coupler comprises a pair of opposed bushings, wherein each of the opposed bushings has a keyed feature configured to matingly engage the upper to inhibit rotation of the bushing during pivoting of the lower-leg engagement portion relative to the foot engagement portion.

5. A motorcycle riding boot according to claim 4, wherein the foot engagement portion has an interior surface and an exterior surface, the interior surface defining a first interface including a first keyed feature positioned on a first lateral side of the foot engagement portion and a second interface including a second keyed feature positioned on an opposing second lateral side of the foot engagement portion.

6. A motorcycle riding boot according to claim 5, wherein the pair of opposed bushings includes a first bushing disposed along the interior surface and positioned to engage the first interface, the first bushing having a third keyed featured configured to interlock with the first keyed feature to inhibit rotation of the first bushing during pivoting of the lower-leg engagement portion relative to the foot engagement portion.

7. A motorcycle riding boot according to claim 6, wherein the pair of opposed bushings includes a second bushing disposed along the interior surface and positioned to engage the second interface, the second bushing having a fourth keyed feature configured to interlock with the second keyed feature to inhibit rotation of the second bushing during pivoting of the lower-leg engagement portion relative to the foot engagement portion.

8. A motorcycle riding boot according to claim 7, wherein the third keyed feature of the first bushing is configured differently from the fourth keyed feature of the second bushing.

9. A motorcycle riding boot according to claim 7, wherein the foot engagement portion defines a first aperture extending through the first interface and a second aperture extending through the second interface.

10. A motorcycle riding boot according to claim 9, wherein the first aperture and the second aperture define an axis extending therethrough about which the lower-leg engagement portion pivots relative to the foot engagement portion, the first bushing, and the second bushing.

11. A motorcycle riding boot according to claim 9, wherein the lower-leg engagement portion defines a third aperture positioned to correspond with the first aperture of the foot engagement portion and a fourth aperture positioned to correspond with the second aperture of the foot engagement portion.

12. A motorcycle riding boot according to claim 11, wherein the first bushing includes an first extension that extends through the first aperture and the third aperture, and wherein the second bushing includes a second extension that extends through the second aperture and the fourth aperture.

13. A motorcycle riding boot according to claim 12, wherein the first extension and the second extension are each configured to receive a fastener to retain the lower-leg engagement portion in a pivotable relationship with the foot engagement portion.

14. A motorcycle riding boot according to claim 13, wherein the first fastener and the second fastener directly apply pressure to the lower-leg engagement portion to hold the lower-leg engagement portion against the exterior surface of the foot engagement portion.

15. A motorcycle riding boot according to claim 5, wherein the first keyed feature and the second keyed feature extend from the interior surface towards an interior of the foot engagement portion.

16. A motorcycle riding boot according to claim 4, further comprising a stop configured to limit a rotational range of motion of the foot engagement portion relative to the lower-leg engagement portion to within an anatomically acceptable rotational range of motion.

17. A motorcycle riding boot according to claim 16, wherein the stop includes a first surface positioned at a rear of the lower-leg engagement portion and a second surface positioned at a rear of the foot engagement portion.

18. A motorcycle riding boot according to claim 17, wherein the first surface and the second surface are positioned to engage each other at a target degree of extension of the foot engagement portion relative to the lower-leg engagement to limit the range of motion of the foot engagement portion relative to the lower-leg engagement portion.

* * * * *